US005584791A

United States Patent [19]

Grimwood et al.

[11] Patent Number: 5,584,791

[45] Date of Patent: Dec. 17, 1996

[54] DECANTING CENTRIFUGES WITH IMPROVED COMPRESSION

[75] Inventors: Geoffrey L. Grimwood; Geoffrey C. Grimwood, both of Holmfirth, England

[73] Assignee: Thomas Broadbent & Sons Ltd., Huddersfield, England

[21] Appl. No.: 153,743

[22] Filed: Nov. 17, 1993

[30] Foreign Application Priority Data

Dec. 1, 1992 [GB] United Kingdom ..... 9225067

[51] Int. Cl.[6] ..... B04B 1/20

[52] U.S. Cl. ..... 494/54; 494/53

[58] Field of Search ..... 494/36, 52–56, 494/85; 210/380.1, 380.3

[56] References Cited

U.S. PATENT DOCUMENTS

| | | | |
|---|---|---|---|
| 775,320 | 11/1904 | Van Kirk | 494/53 X |
| 2,308,559 | 1/1943 | Winkler | 494/36 X |
| 2,679,974 | 6/1954 | Gooch | 494/53 X |
| 2,743,864 | 5/1956 | Lyons | 494/54 |
| 3,348,767 | 10/1967 | Ferney | 494/36 X |
| 3,401,800 | 9/1968 | Stock | 210/380.3 |
| 3,430,850 | 3/1969 | Gilreath . | |
| 4,416,656 | 11/1983 | Shapiro | 494/53 |
| 4,449,967 | 5/1984 | Caldwell | 494/54 |
| 4,654,022 | 3/1987 | Shapiro | 494/29 |
| 5,067,939 | 11/1991 | Shapiro | 494/53 |
| 5,176,616 | 1/1993 | Schlip et al. | 494/53 X |
| 5,261,869 | 11/1993 | Caldwell et al. | 494/54 |

FOREIGN PATENT DOCUMENTS

| | | | |
|---|---|---|---|
| 1067028 | 6/1954 | France . | |
| 1554156 | 12/1968 | France . | |
| 2548925 | 7/1984 | France . | |
| 969241 | 5/1958 | Germany . | |
| 1482719 | 1/1970 | Germany | 494/54 |
| 2152839 | 4/1973 | Germany . | |
| 63-194760 | 8/1988 | Japan | 494/53 |
| 271859 | 3/1990 | Japan | 494/53 |
| 347084 | 8/1972 | U.S.S.R. | 494/54 |
| 584893 | 12/1977 | U.S.S.R. | 494/36 |
| 724212 | 3/1980 | U.S.S.R. | 494/54 |
| 923627 | 4/1982 | U.S.S.R. | 494/36 |
| 1380782 | 3/1988 | U.S.S.R. | 494/53 |
| 2064997 | 6/1981 | United Kingdom . | |
| 2103502 | 2/1983 | United Kingdom . | |
| 2145944 | 4/1985 | United Kingdom | 494/53 |
| WO-8404470 | 11/1984 | WIPO . | |
| 9322062 | 11/1993 | WIPO | 494/53 |

*Primary Examiner*—Charles E. Cooley
*Attorney, Agent, or Firm*—Blakely, Sokoloff, Taylor & Zafman

[57] ABSTRACT

A decanting type centrifuge comprising a bowl which rotates about a horizontal or vertical axis and contains a helical screw conveyor for separating a slurry fed to the bowl into its constituent solids and liquid, the scroll being arranged to rotate at a differential speed within the bowl and wherein at least some of the flights of the scroll conveyor are inclined backwards relative to the solids discharge end of the bowl.

12 Claims, 14 Drawing Sheets

DECANTING CENTRIFUGES WITH IMPROVED COMPRESSION

BACKGROUND OF THE INVENTION

The present invention relates to centrifuges of the decanting type.

Decanting type centrifuges employ a bowl which rotates about a horizontal or vertical axis and contains a helical scroll conveyor to separate a slurry fed thereto into its constituent solids and liquid. The helical conveyor rotates at a slightly different speed within the bowl to scroll the heavier solids to discharge ports at the smaller diameter end of the bowl. The separated liquid flows in the opposite direction and is discharged from ports at the opposite end of the bowl. The decanter can be of two principle types, either solid bowl or screen bowl. In the latter, the solids are scrolled by the conveyor over an additional perforated screen section of the bowl prior to discharge.

Existing decanter centrifuges of both the solid and screen bowl types operate when fed with a slurry containing solids with a higher specific gravity than the liquid constituent of the slurry either to:—

(a) separate the solid particles from the liquid, or to (b) classify the solids, that is to divide the solids so that particles above a certain size are discharged as solids and particles below that size are discharged with the liquid.

For both separation and classification, the rotation of the decanter applies centrifugal force to the slurry to promote rapid settling of the higher specific gravity for scrolling and discharge. In the description that follows, the words "separate" and "separation", when applied to solids and liquids, includes "classify" and "classification".

FIG. 1 of the accompanying drawings shows, in part section, a conventional state-of-the-art solid bowl decanter designed to rotate about axis XX and to separate slurry fed via feed pipe (1) and feed ports (2) into the bowl (3), which includes a cylindrical section (3A) joined to a section shaped as a frustrum of a cone (3B)—herein referred to as the conical bowl section. The slurry, subjected to centrifugal force, fills the bowl to the inner surface (4) determined by the radial position of the liquid outlet ports (5). A conveyor hub (6) coaxially mounted within the bowl (3) and supported on bearings (7), carries scrolling flights (8) wound in a helix and attached to the hub (6). The plane of the scrolling flights tilts forward to subtend an angle (a), typically 0°–4° to the generator of the cylindrical (3A) or the conical (3B) sections of the bowl (3). A gearbox (not shown) drives the conveyor (6) in the same rotation but at a speed slightly different from the bowl (3) such that the flights scroll towards the solids discharge end (9) of the decanter. Under centrifugal force, the solids (10) settle rapidly on the bowl wall and are scrolled by the conveyor flights (8) and discharged from the solids outlet (11) whilst the liquid, after primary separation, flows from the outlet (5).

The centrifugal force produced by rotation results in compressive forces on the solids. For the solids in the conical bowl section (3B) and scrolled clear of the liquid surface (4), the compressive forces are zero at the minimum solids radii and increase linearly to a maximum value at the inner wall of the conical bowl section. The solids immersed in the liquid are subjected to a compressive force applied by the liquid "head" which again is zero at the liquid surface (4) and a maximum at the inner bowl wall. In the description that follows the words "compression" and "compressive forces" apply only to forces applied mechanically to the solids by the decanter components and do not include the compressive forces induced directly by rotation.

An object of the present invention is to improve the design of conventional decanting centrifuges so that, in addition to separating the slurries of solids and liquid as described above (the primary separation), the part-dried solids are also subjected to applied compressive forces during scrolling to remove additional liquid before being discharged from the bowl (the secondary and tertiary separations).

A further object is to collect the liquid extracted by the primary and subsequent separations in individual streams for further processing.

SUMMARY OF THE INVENTION

In accordance with the present invention, there is provided a decanting type centrifuge comprising a bowl which rotates about a horizontal or vertical axis and contains a helical screw conveyor for separating a slurry fed to the bowl into its constituent solids and liquid, the scroll being arranged to rotate at a differential speed within the bowl, characterised in that at least some of the flights of the scroll conveyor are inclined backwards relative to the discharge end of the bowl.

Preferably, the bowl has a cylindrical part and a frusto-conical part, the solids outlet being located at the smaller diameter end of the frusto-conical part, and wherein the backwardly inclined flights of the scroll conveyor are located on that section of the screw conveyor which lies within the frusto-conical part of the bowl.

In one embodiment, the backwards inclination of the flights is at a fixed angle for all flights.

In another embodiment, the angle of said backward inclination increases progressively or in steps as the diameter of the conical bowl reduces towards the solids discharge end.

In a further embodiment, the pitch of the inclined flights reduces progressively from the larger diameter end to the smaller diameter end of the conical bowl part.

In yet another embodiment, the conveyor comprises a hub mounted coaxially within the bowl, the hub having a cylindrical section remote from the solids outlet end of the bowl and a divergent section adjacent the solids outlet end of the bowl.

In the latter case, the divergent part of the conveyor hub can contain perforations. Preferably, the perforations are located on a helix at the junctions of the inclined flights and support plates therefor fixed to the hub. The additional liquid extracted flows through these perforations for collection as a separate stream.

In a still further embodiment, the hub has a cylindrical section remote from the solids outlet end of the bowl and a convergent section adjacent the solids outlet end of the bowl. Again this convergent section may be perforated so that the additional liquid extracted is collected as a separate stream.

In a final embodiment the conveyor hub is unperforated and the conical part of the bowl contains slotted openings of small dimensions to form a screen section for the passage and collection of the additional liquid extracted.

In all of the above described embodiments, shaped facing pieces can be fitted to the inclined flights to reduce the inclination angle locally at the radially outer ends of these flights, adjacent the inner surface of the conical section of the bowl. These facing pieces are preferably replaceable and can be made of a hard material, such as a ceramic.

BRIEF DESCRIPTION OF THE DRAWINGS

The invention is described further hereinafter, by way of example only, with reference to the accompanying drawings, in which:—

DESCRIPTION OF THE PREFERRED EMBODIMENTS

Figure 1:
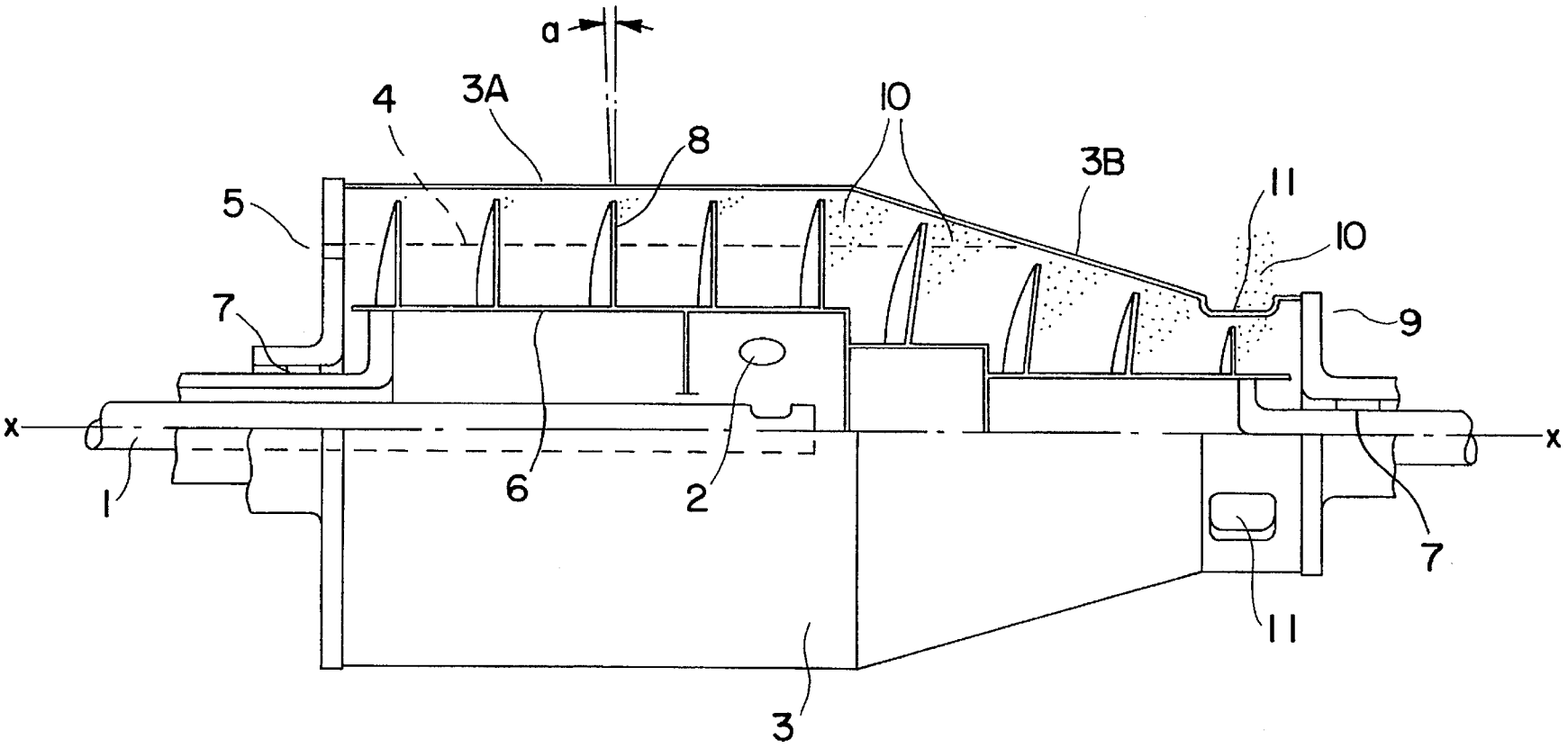
FIG. 1 PRIOR ART
FIG. 1 is a partial longitudinal section through an embodiment of a conventional decanting type centrifuge.
Figure 2:
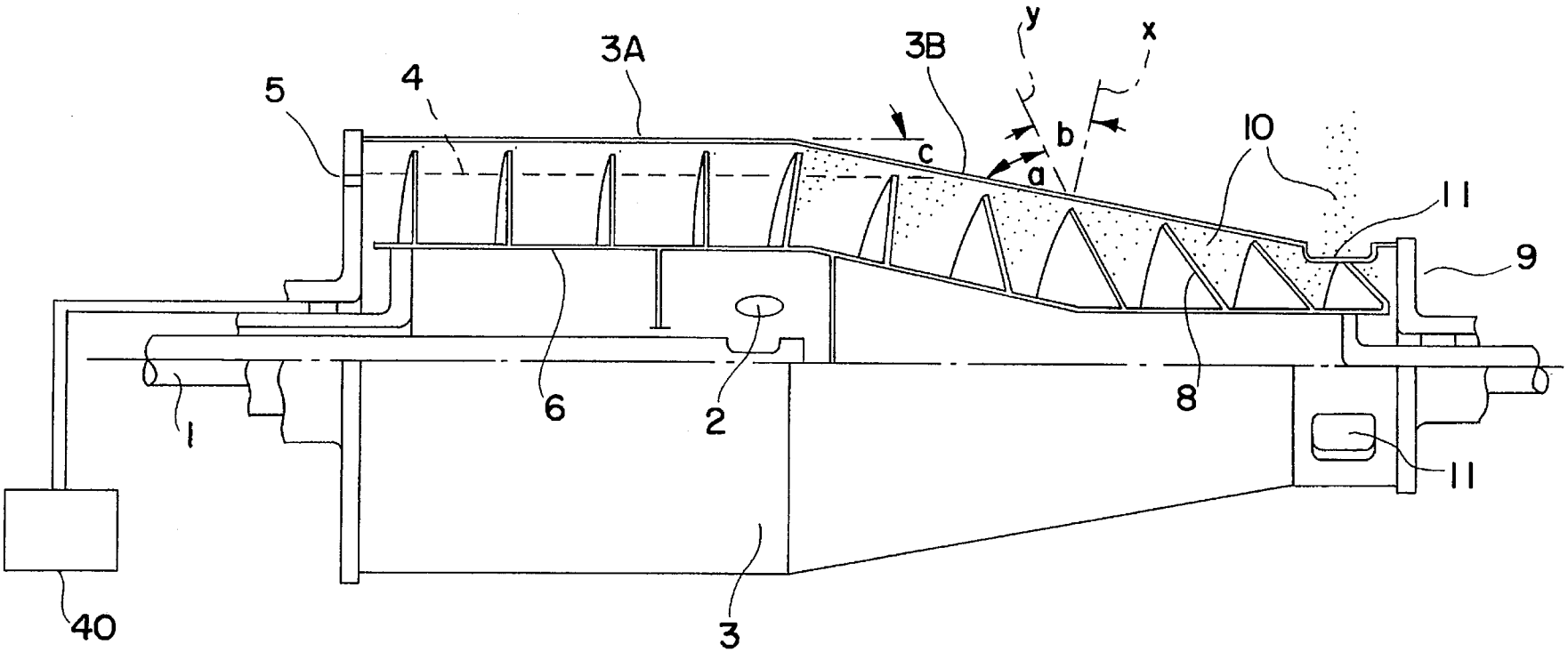
FIG. 2 and 2*a* show a partial longitudinal section through one embodiment of a decanting type centrifuge in accordance with the present invention.
Figure 2A:
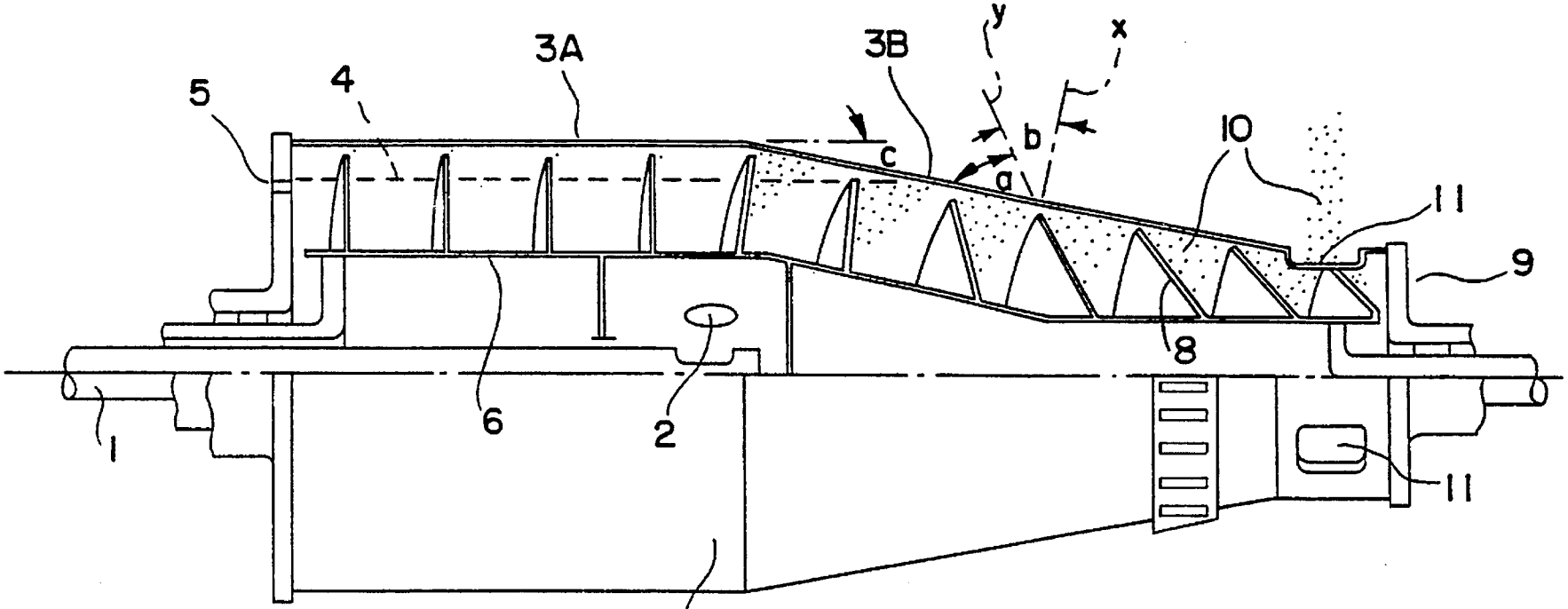

FIG. 2 shows a first example of the improved design to apply mechanical compressive forces to the part-dried solids. The same reference numerals are used to identify corresponding parts to those shown in FIG. 1. From the large diameter to the small diameter end of the conical bowl section (3B), the scrolling flights (8) are inclined backwards at angle (b), the angle increasing as the diameter of the conical bowl (3B) reduces, while the acute angle "a" decreases, "a" being the angle formed between the scrolling flights (8) and the internol surface of the cornical section (3B), "a" being also the complement of angle "b", i.e., "a"=90°–"b" as shown in FIG. 2 or remaining constant at angle (b). The inclined flights (8), in scrolling the solids, exert compressive forces by pushing the solids (10) into the acute angle formed between the backwardly inclined flights (8) and the angle (c) of the conical bowl section (3B).

In FIG. 2, the angle "b" is defined between lines X and Y. The line Y corresponds to the radial surface direction at a given position on the scroll and the line X corresponds to the direction of the normal to the inside surface of the bowl at the closest point on the bowl. Thus, in the apparatus of FIG. 2 in accordance with the present invention, the front face of the scroll flight (8) forms an angle "a" (=90–b) in relation to the inside surface of the bowl which is less than 90°, compared to the conventional apparatus of FIG. 1 where the corresponding angle "a" would typically be in the range 90°–93°.

Figure 3A:
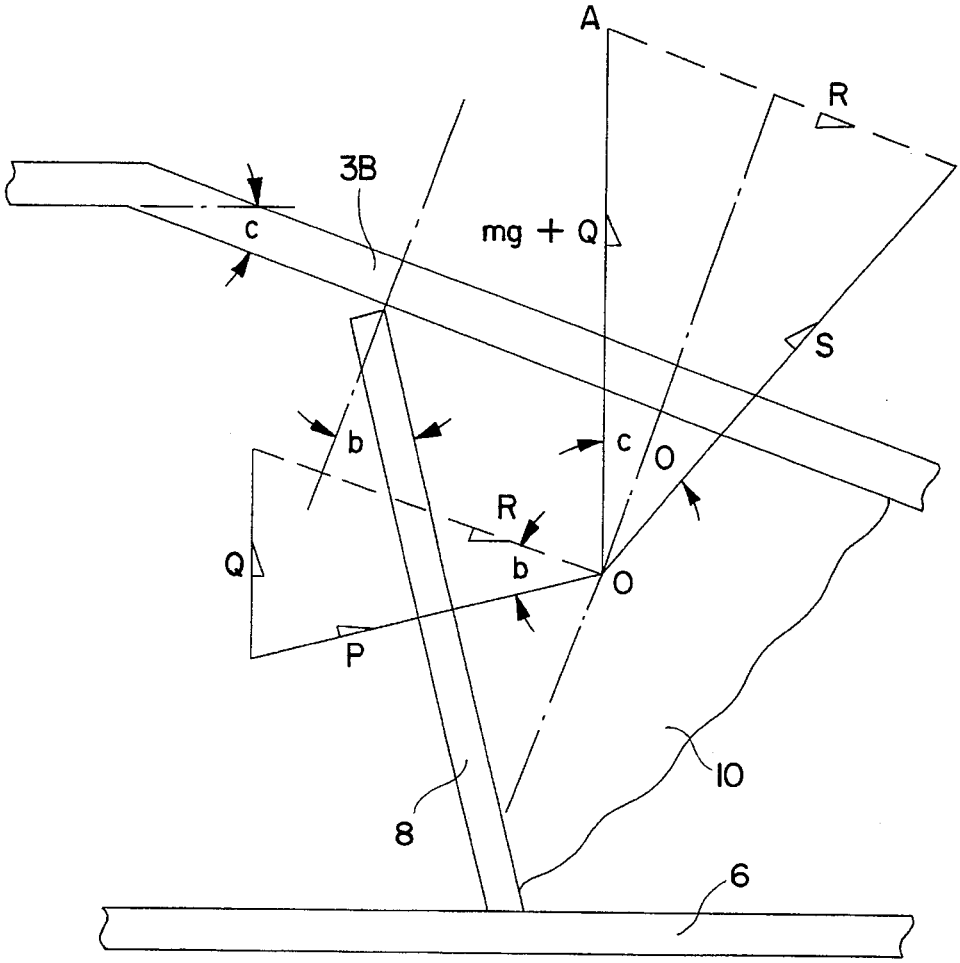
FIG. 3A illustrates the forces on elemental segments of solids.

Following primary separation in the cylindrical bowl section (3A), the solids, once free of the liquid surface (4) are no longer fluid. Whilst the forces exerted on these solids by the inclined conveyor flights (8) are complex, to the first approximation they obey the laws of friction of solids on an inclined plane. On that basis and taking a simplified two-dimensional view, FIG. 3A shows the forces on an elemental segment of solids (10) of mass m (bounded by the conical bowl section (3B) and two radial planes both intersecting the axis XX and subtending to each other a small angle, typically less than 5°). The total solids content within the conical bowl section (3B) and clear of the liquid is made up of a series of many such elemented volumes lying adjacent to each other to form a helix of solids of near triangular section. The solids occupy part of the space provided between the conical bowl section (3B), the conveyor hub (6) and the inclined flights (8), this space being referred to herein as the helical volume. The force applied to the solids (10) by the flight (8) has a component P in the plane of FIG. 3A acting through the centre of gravity 0 of the elemental solids section. The force P is resolved into force R (the force that pushes the solids along the inclined bowl wall) and Q (the compressive force). Force Q acts radially outwards, colinear with the centrifugal force m.g. The magnitude of force R is just sufficient to push the solids up the inclined slope (c) of the conical bowl section and overcome the frictional forces between the solids and the conical bowl wall—the friction coefficient being $\mu=\tan\phi$. The triangle of forces OAB relates R to the total outward radial force mg+Q and the reaction (S) necessary to overcome the frictional forces.

The formula expressing the compressive force Q in terms of the centrifugal force m.g, the flight inclination (b), the conical bowl section angle (c) and the coefficient of friction $\mu$ is:—

$$\frac{Q}{m.g.}=\frac{\sin b\,(\sin c+\mu\cdot\cos c)}{\cos c\,(\cos b-\mu\cdot\sin b)}$$

Figure 3B:
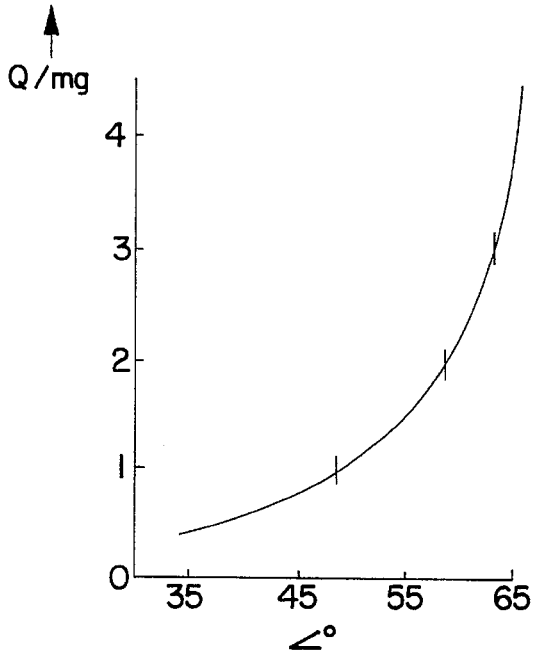
FIG. 3B shows the magnitudes of forces for various flight inclinations.

FIG. 3B shows the magnitude of force Q for various values of flight inclination (b), given typical values of conical bowl section angle (c)=10° and coefficient of friction between solids and conical bowl section (3B) of ($\mu$)=0.35. For a flight inclination (b) of approximately 48°, "a" being 42°, the compressive force is equal to the mean centrifugal force. Increasing the inclination (b) to about 58° doubles and to 63° triples the compressive force the acute angle "a" decreasing to 32° and respectively 27°.

It is these substantial compressive forces that complete the secondary separation by extracting or squeezing more liquid from the solids—the liquid flowing towards the larger diameter end of the conical bowl section (3B) to join the free liquid in the cylindrical section (3A) and to flow from the discharge ports (5).

For the prior art decanter shown in FIG. 1, flight angle (b) is zero or negative, meaning that acute angle "a" is 90° or higher, no compressive force is applied to the solids and no secondary separation takes place.

Figure 4:
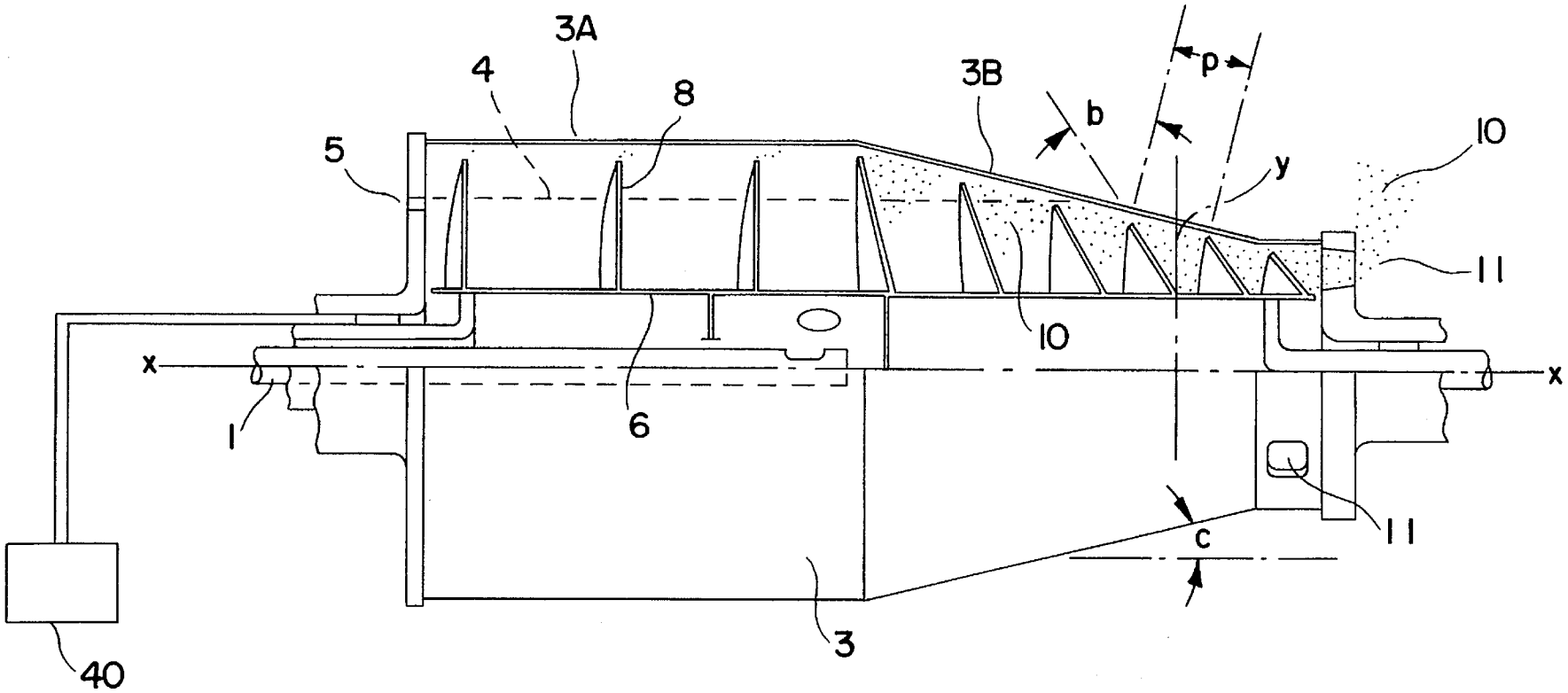
FIGS. 4 and 4*a* show a partial longitudinal section of a second embodiment in accordance with the present invention.
Figure 4A:
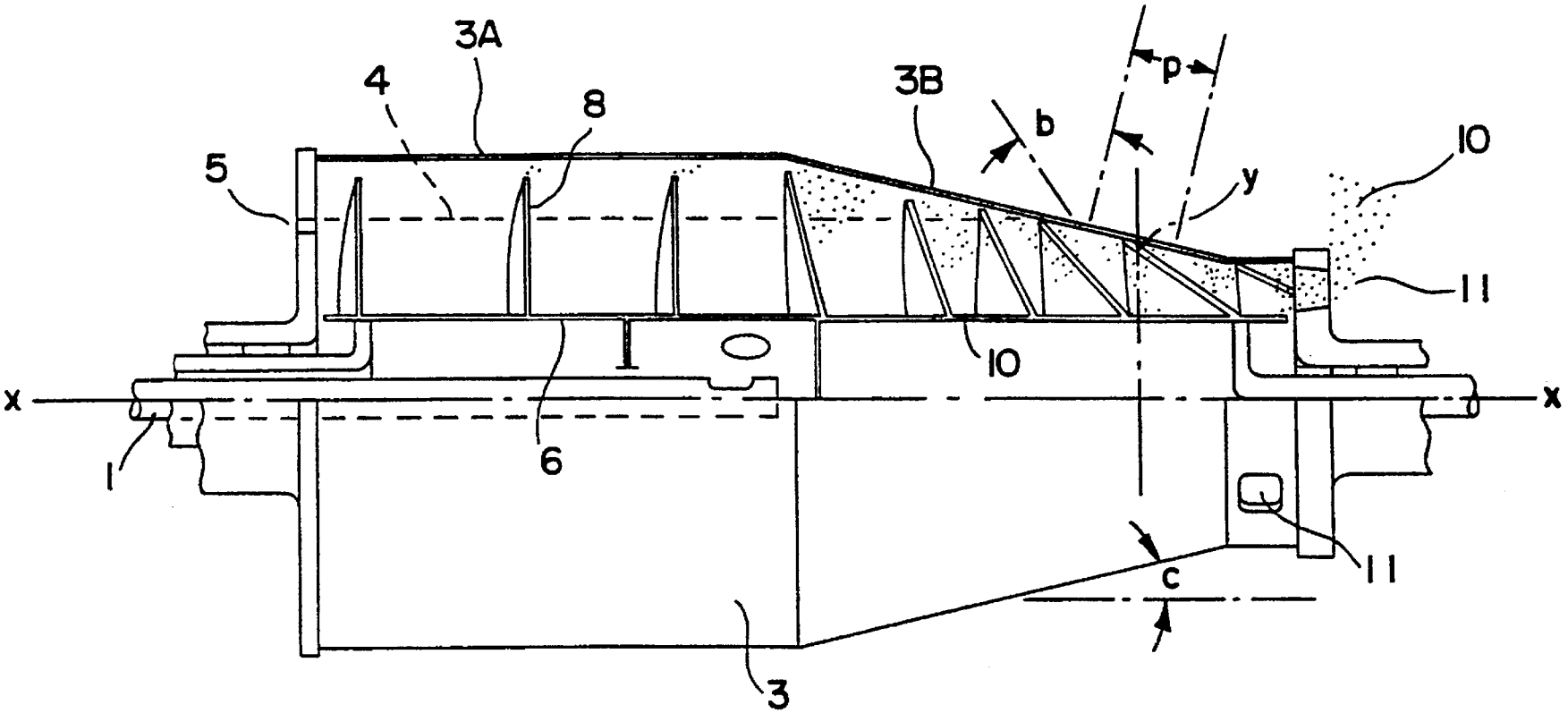

FIG. 4 shows a further improvement to apply additional mechanical compressive forces to the solids following the secondary separation described above and illustrated in FIGS. 2, 3A and 3B. Here the pitch (p) of the inclined flights progressively reduces from the larger diameter to the smaller diameter of the conical bowl section.

The helical volume formed between adjacent scrolling flights (8), the conical section (3B) and the conveyor hub (6) reduces progressively and substantially from the large to the small diameter end of the conical bowl section (3B), typically by 35 to 75%. The solids in their passage through the conical bowl section are first subjected to secondary separation. At a plane Y (at right angles to the axis XX), the progressive reduction in the helical volume is such that the solids now completely fill the helical volume. In scrolling the solids past plane Y to the solids outlet (11), the conveyor flights (8) induce additional compressive forces by squeezing the solids into a smaller and reducing volume until they are finally discharged. It is during this scrolling period from plane Y to discharge ports (11) under increasing compression that further liquid is removed from the solids, to complete the third or tertiary dewatering stage.

Figure 5:
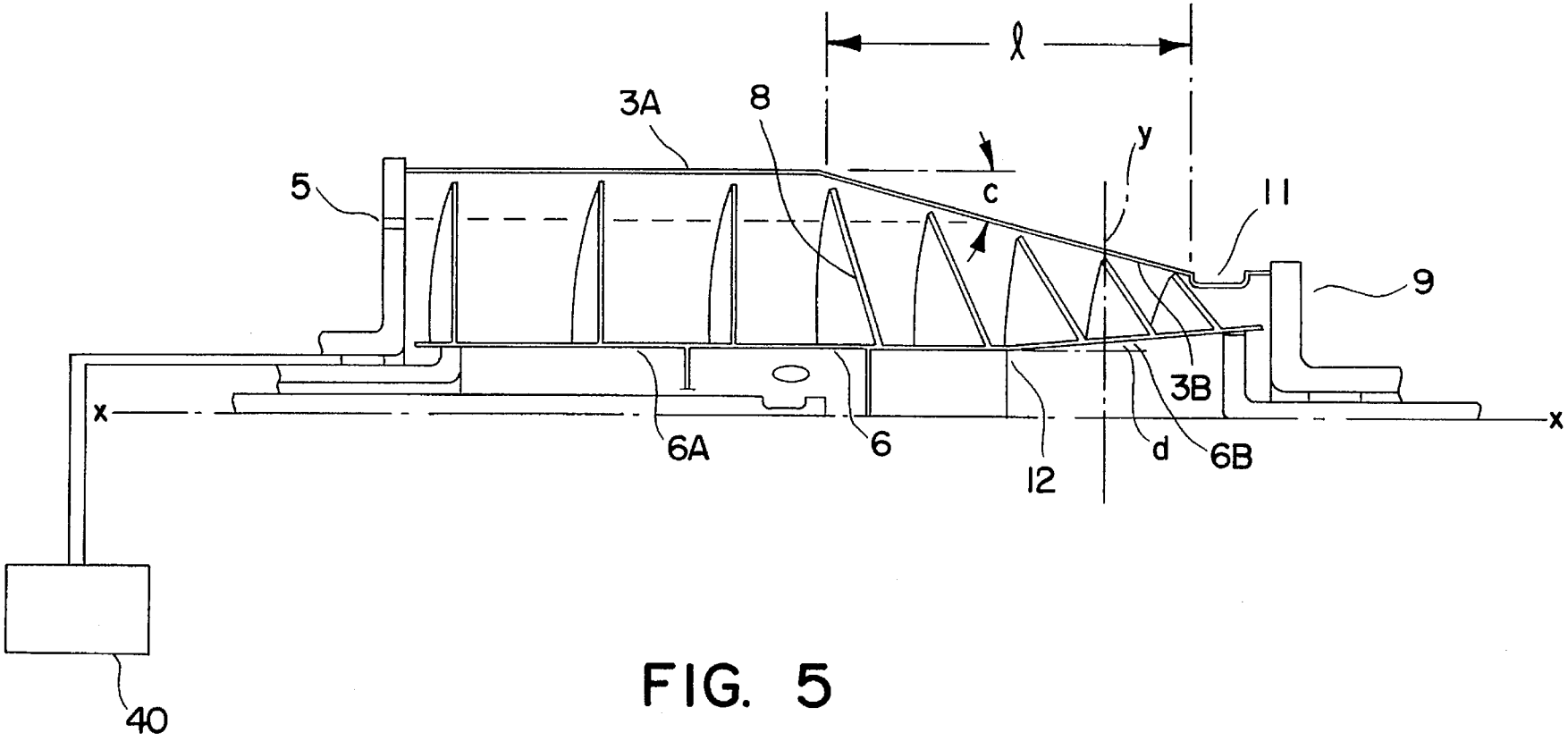
FIGS. 5 and 5*a* show a half section of a preferred arrangement for increasing both centrifugal and compressive forces whilst reducing gear box power.
Figure 5A:
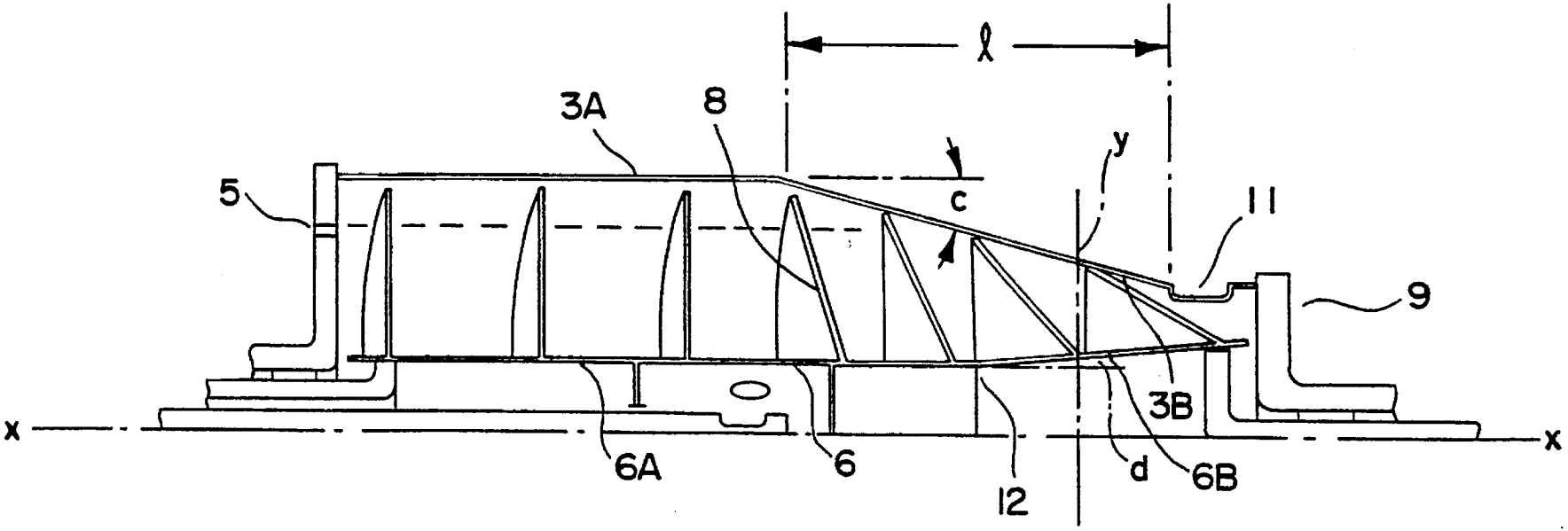

FIG. 5 shows a half section of one preferred arrangement to increase both the centrifugal and compressive forces whilst reducing the gearbox power needed to scroll the solids to discharge. In this arrangement the conveyor hub (6) is divided into a cylindrical hub section (6A) and a divergent hub section (6B). The junction (12) between these sections is positioned further from solids discharge end of the decanter (9) than the plane Y at which the solids first occupy all of the available helical volume. Compression takes place, after the solids are scrolled beyond plane Y to fill the progressively reducing helical volume produced by the increasing divergent hub diameter (d) in addition to the reducing conical bowl section diameter and the conveyor blades of increasing inclination, thus decreasing the acute angle "a" and/or reducing pitch.

This latter arrangement offers a combination of the following advantages:—

(a) a more rapid reduction in the helical volume formed between the scrolling flights (8), the conical bowl section (3B) and inclined conveyor hub section (6B), resulting in an increase in the rate of rise of compressive forces over the axial length (1) of the conical section (3B);

(b) a relative increase in the diameter of the solids discharge ports (11), thus increasing the centrifugal force applied to the solids within the conical bowl section (3B); and (c) for a given rate of increase of compression, a reduction in the conical bowl section angle (b) and/or the axial length (1) giving a relative reduction in the total gearbox power needed to scroll the solids from the cylindrical bowl section (3A) to the solids outlet (11).

Figure 6:
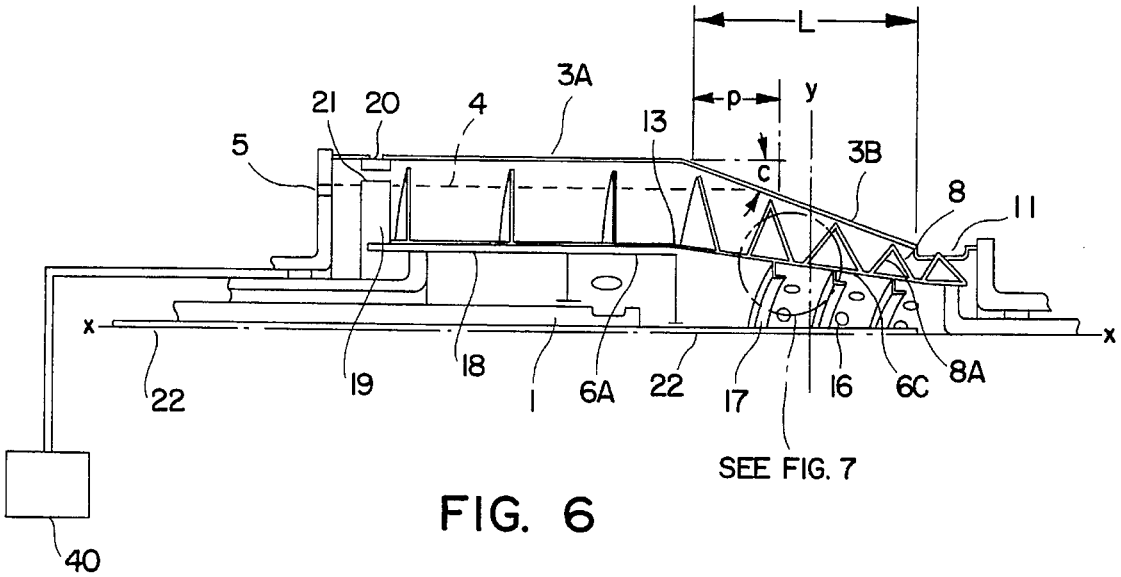
FIGS. 6 and 6*a* illustrate an alternative arrangement for providing a separate stream of liquid from the tertiary and latter stages of the secondary operation.

FIG. 6 shows an alternative arrangement to provide a separate stream of liquid from the tertiary and latter stages of the secondary separation. The conveyor hub (6) is divided into a cylindrical hub section (6A) and a convergent hub section (6C) joined symmetrically at junction (13). The convergent section (6C) is perforated locally so that the liquid extracted by compression flows inwards through the perforations in the conveyor hub (6C) to be collected separately.

To achieve the required reduction in helical volume in the arrangement shown in FIG. 4 (in which the reduction would otherwise be in function of the difference between the conical bowl angle (c) and the convergent hub section angle (d), the convergent hub section angle (d) being smaller than the conical bowl angle (c), as illustrated in FIG. 6), the conveyor flights (8) are fitted with continuous helical support plates (SA) at least from plane Y to the solids discharge ports (11). The reduction in the helical volume as the solids are scrolled is achieved in this illustration by the angle (e) and relative axial position of the support plates (8A) in addition to the reducing conical bowl diameter and/or the increasing inclination (b) of the conveyor blades, thus, decreasing the acute angle "a" and/or the reducing pitch (p).

Figure 7:
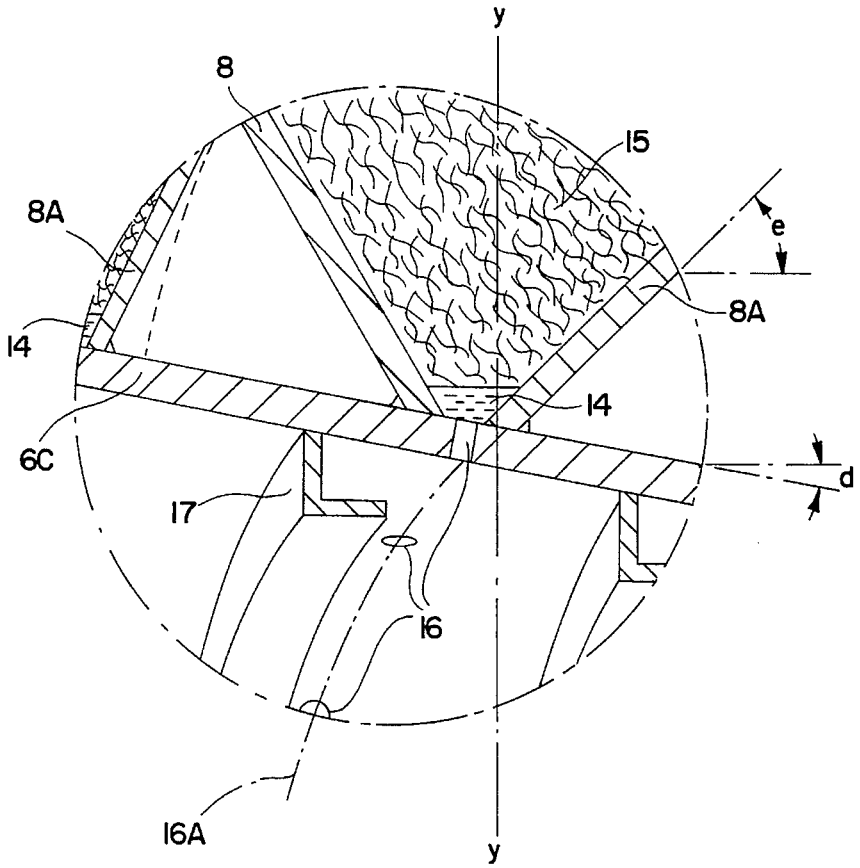
FIG. 7 shows an enlarged section of the convergent hub, inclined conveyor flight and support plate in the vicinity of plane Y in FIG. 6.
Figure 6A:
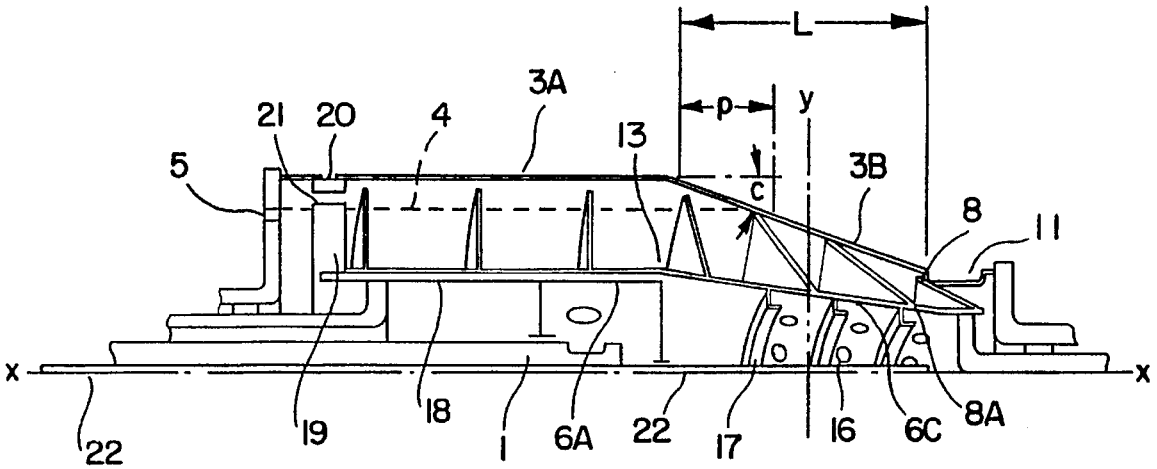

FIG. 7 is an enlarged section of the convergent hub (6C), inclined conveyor flight (8) and support plate (8A) in the vicinity of plane Y in FIG. 6. At the latter stages of the secondary separation as the solids approach plane Y the liquid (14), of lower specific gravity than the solids, is forced to the inner surface of the solids (15). The convergent hub (6C) is perforated (16) at intervals near the junction of the conveyor flight (8) and the adjacent support plate (8A), the perforations being spaced along helix line (16A) concurrent with that of the conveyor flights and extending on both sides of the plane Y. The compressive forces during both the tertiary separation and the latter stages of the secondary separation cause the liquid (14) to flow through the perforations (16) and along the inside surface of the concurrent hub (6C). An angled trough (17) (shaped as a helix, and fitted to the inside of the convergent hub (6C)) collects the liquid flowing through the perforations (16) and channels it to the large diameter end of the convergent hub (6C). The liquid then flows through pipes (18) fitted to the cylindrical conveyor hub (6A) to chamber (19) and is collected separately at bowl ports (20). The liquid separated by primary separation and the early stages of secondary separation flows through pipes (21) sealed to cross chamber (19) and is collected separately from bowl outlet ports (5). A wash pipe (22) is fitted for the periodic flow of wash liquor to remove any fine solids passing through the perforations (16) and deposited in the trough (17) or pipe(s) (18).

Figure 8:
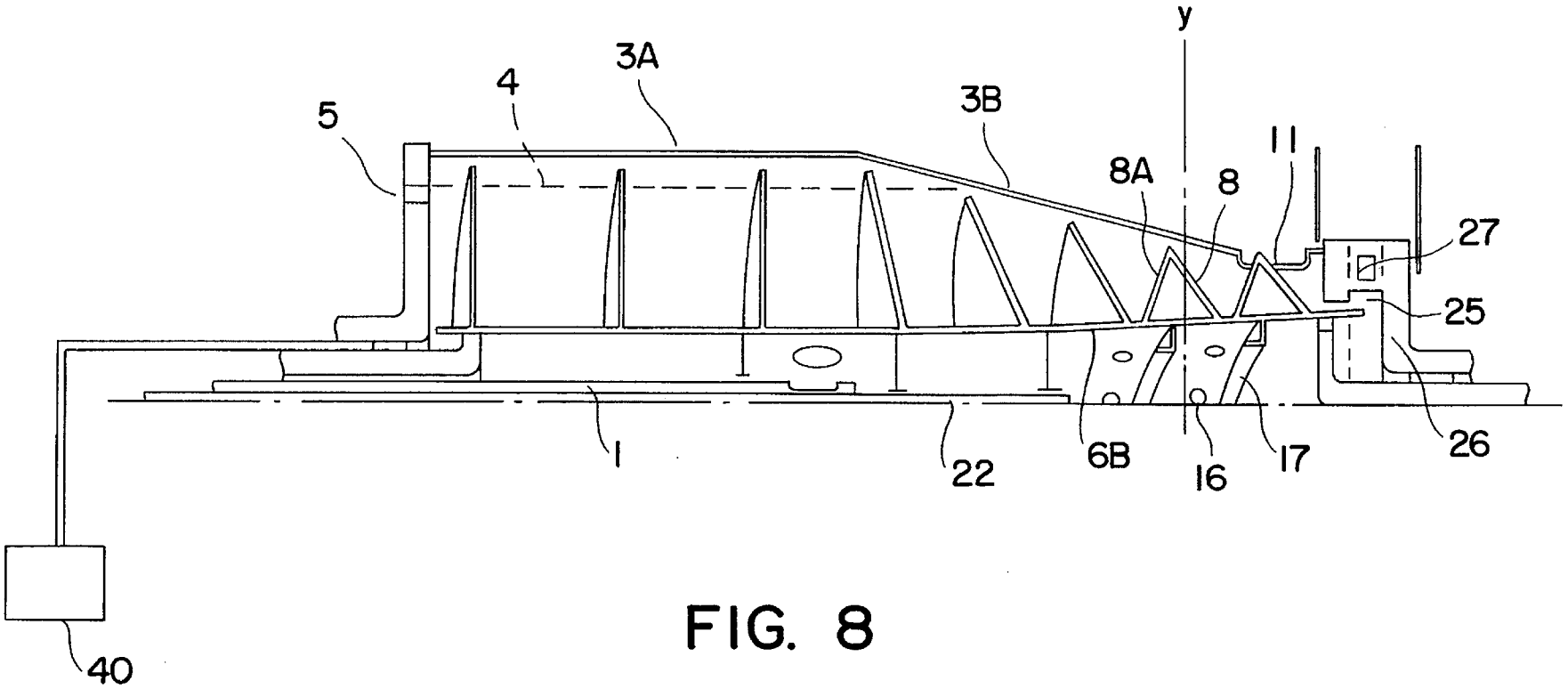
FIGS. 8 and 8*a* show a second alternative for providing a separate stream from the tertiary and late secondary separation but using a divergent conveyor hub.
Figure 8A:
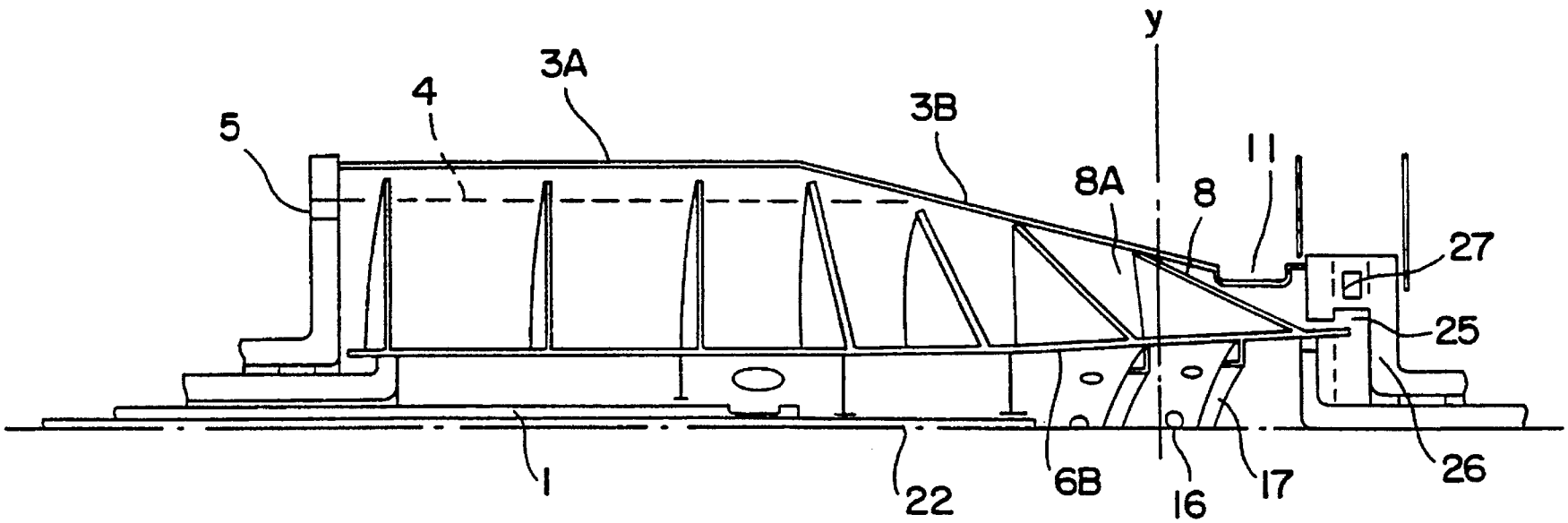

FIG. 8 shows a second alternative to provide a separate stream from the tertiary and late secondary separation but using a divergent conveyor hub section to increase the compressive forces during tertiary separation. The decanter is similar to that shown in FIG. 5 with provision for liquid flow through the divergent hub section (6B) which has perforations (16) drilled at intervals on a helix at the junction of the inclined flights (8) and support plates (8A), the perforations extending on both sides of plane Y, as in FIG. 7. An angled trough (17) is fitted on the inside of the divergent hub (6B) to collect the liquid forced through the perforations by the compressive forces. The trough carries the extracted liquid towards the solids discharge end, with the divergent hub (6B) extended to pass into an internal recess in the bowl end casting (26). The liquid flows over the lip of the extended divergent hub, into the recess (25) and radially outwards under centrifugal force for collection after flowing through the openings (27) in the outer periphery of the bowl end casing (26).

The arrangements shown in FIGS. 6 and 8 are preferred when the solids contain fibrous material, material that deforms readily under compressive forces and/or when the liquid separated by compression and any solids carried over with this liquid require further processing that differs from that applied to the primary separated liquid or is required for recirculation to the feed pipe (1).

Figure 9:
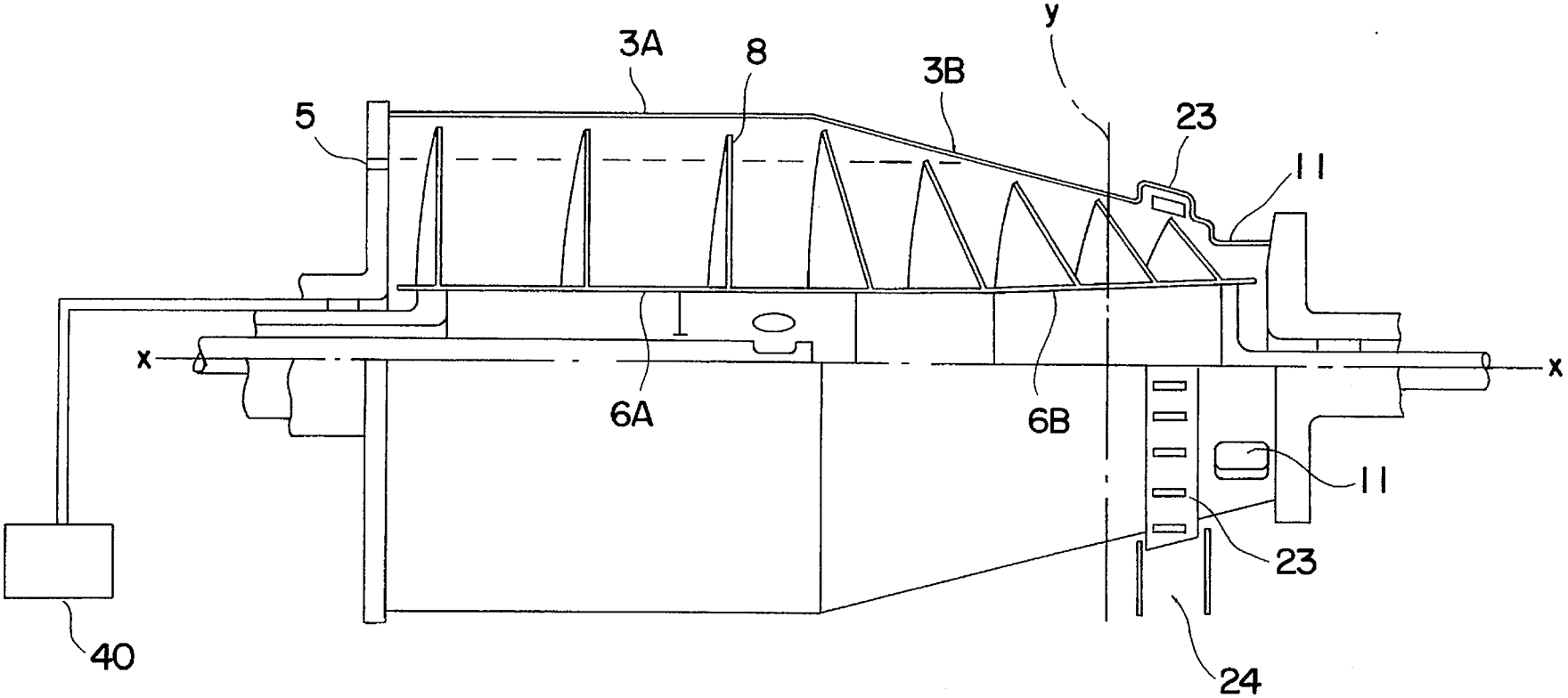
FIG. 9 shows a preferred arrangement for use when the solids are virtually free of fibrous and/or easily compressible material.

FIG. 9 shows a preferred arrangement for use when the solids are virtually free of fibrous and/or easily compressible material and contain a sufficient proportion of rigid particulate solids that will allow the liquid, separated by compression, to flow under centrifugal force outwards through the particulate solid bed. As before, the solids after primary separation, are scrolled by the conveyor through the reducing helix volume for secondary separation until at plane Y the solids fill the helical volume completely and are then subjected to further compression for tertiary separation. Between plane Y and the solids outlet (11) a part of the bowl wall has slotted openings of a minimum dimension in the range 50–500 microns to form a screen section (23). The solids within the screen are subject to compression for the purpose of removing additional liquid which migrates outwards under centrifugal force through the interstical spaces between the particulate solids to the bowl, to flow through the openings (23). This liquid is collected separately from the primary and secondary separated liquid via the opening (24). This arrangement combines the advantages stated for FIG. 5 whilst separating the tertiary liquid stream.

Figure 10:
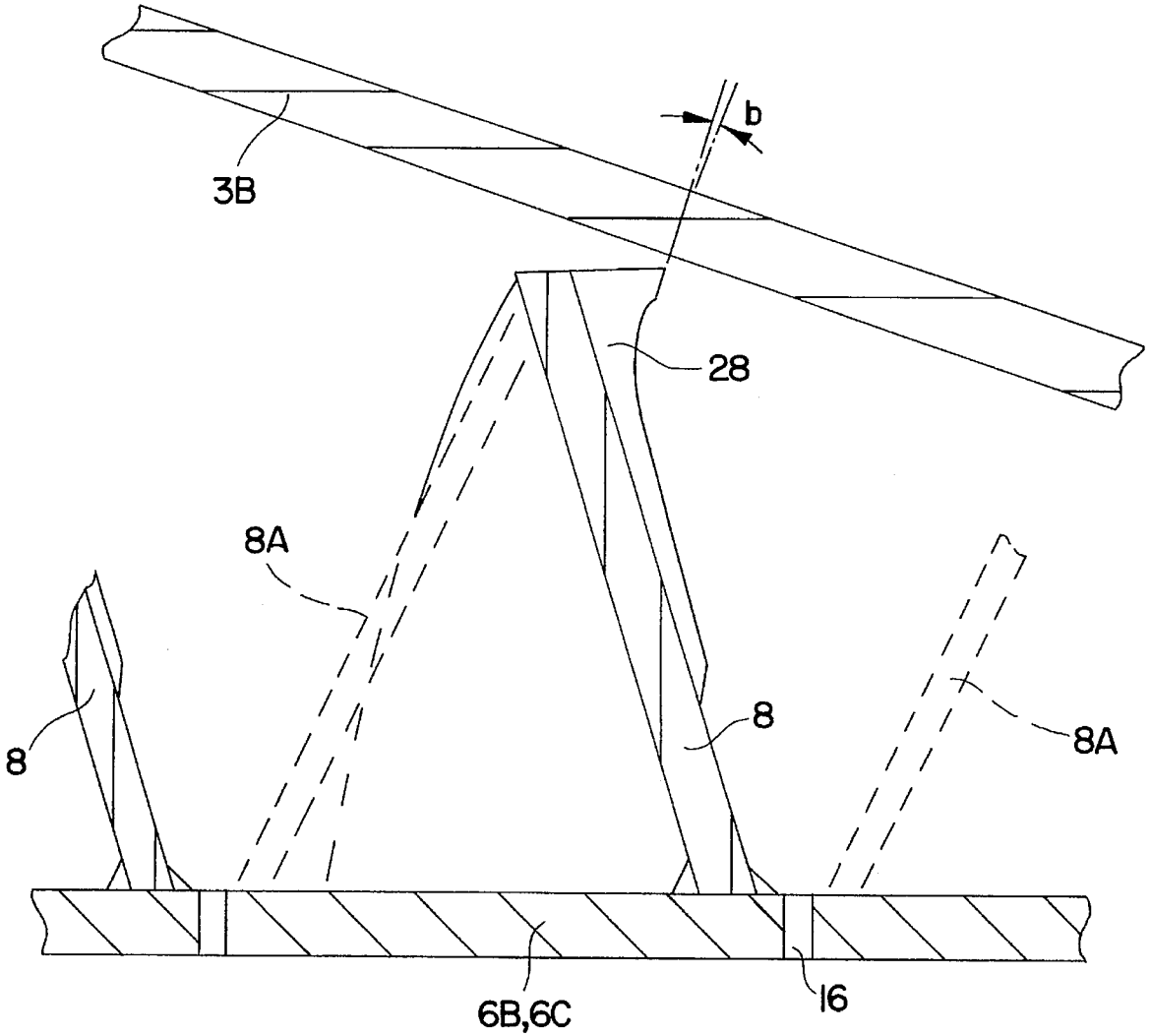
FIG. 10 shows an additional structure for reducing damage to easily fractured solid particles in the slurry.

FIG. 10 shows an addition to all arrangements described above to reduce damage to any easily fractured solid particles that would otherwise be compressed into the gap between the inclined flights (8) and the conical bowl section (3B). Shaped facing pieces (28) are fitted to the flights (8) in the secondary and tertiary compression zones to reduce the angle (b) locally at the conical section inner surface. For processing abrasive solids it is of benefit to make the facing pieces (28) replaceable and in hard material (e.g. ceramic).

In all the arrangements shown above the conveyor (6) is driven by a gearbox (40) at a speed slightly different from, but in the same rotation as, that of the bowl (3). For a given decanter configuration it is well known that the torque delivered by the gearbox to the conveyor is proportional to the solids being scrolled by the conveyor. Known means exist to vary the gearbox ratio automatically to maintain, within the decanter bowl, a constant volume of solids irrespective of fluctuations in the rate and content of the slurry being supplied to the decanter. In all the arrangements shown herein that give tertiary separation between plane Y and solids outlet (11) a known automatic variable ratio gearbox system (40) or the equivalent is used to preset and maintain the position of plane Y relative to the solids outlet (11) so that the solids completely fill the helical volume at the preset plane Y, irrespective of changes in the slurry feed. Whilst not required for the arrangement shown in FIG. 2 it is advantageous to fit an automatic variable ratio gearbox to optimize performance if wide fluctuations in the solids content of the slurry feed occurs.

FIGS. 6, 7 and 8 illustrate the conveyor flight support plates (8A) and the use of these plates to contribute to the reduction of the helix volume as the solids progress from plane Y to outlet (11). In all the arrangements shown that give tertiary separation the optimum rate of reduction in the helix volume between plane Y and the solids outlet (11) may be achieved by utilizing one or more of the following:

* the conical bowl section angle (c)
* the conveyor hub angle (d)
* the conveyor flight inclination angle (b) and acute angle (a) and their rate of change.
* the pitch (p) of the conveyor flights and its rate of change.
* the conveyor support plate angle (c) and its rate of change.

We claim:

1. A decanting type centrifuge comprising:

a bowl journalled for rotation about a horizontal axis and having a cylindrical part with an internal cylindrical surface and a conical part with an internal conical surface having slotted openings to form a screen section, the bowl having a solids discharge end located at the smaller diameter end of the conical part and a liquid discharge end located at that end of the cylindrical part remote from said conical part, further, the bowl having solids discharge outlet adjacent to the solids discharge end and a liquid discharge outlet adjacent to the liquid discharge end;

a scroll conveyor journalled for rotation within the bowl for separating a slurry, fed to the bowl, into its constituent solids and liquid, the scroll conveyor having an unperforated conveyor hub, mounted coaxially within said bowl, and a helical blade carried by said conveyor hub and having a front face which faces the solids discharge end;

the front face of the helical blade of the scroll conveyor, at least in the conical part of the bowl, making an acute angle with said internal conical surface;

means for rotating the bowl about said horizontal axis;

means for rotating the scroll conveyor at a differential speed within the bowl;

means for setting a reference plane within said conical part of said bowl and for configuring a helical volume beyond said reference plane so that said helical volume can be complete filled by wet solids during a centrifuging operation, wherein said helical volume is defined between said helical blade, said internal conical surface, and said conveyor hub; and means for progressively reducing said helical volume between said reference plane and said solids discharge end.

2. A decanting type centrifuge comprising:

a bowl journalled for rotation about a horizontal axis and having a cylindrical part with an internal cylindrical surface and a conical part with an internal conical surface, the bowl having a solids discharge end located at the smaller diameter end of the conical part and a liquid discharge end located at the end of the cylindrical part remote from said conical part, further, the bowl having a solids discharge outlet adjacent to the solids discharge end and a liquid discharge outlet adjacent to the liquid discharge end;

a scroll conveyor journalled for rotation within the bowl for separating a slurry, fed to the bowl, into its constituent solids and liquid, the scroll conveyor having a conveyor hub, mounted coaxially within said bowl, and a helical blade carried by said conveyor hub and having a front face which faces the solids discharge end;

the front face of the helical blade of the scroll conveyor, at least in the conical part of the bowl, making an acute angle with said internal conical surface;

means for rotating the bowl about said horizontal axis;

means for rotating the scroll conveyor at a differential speed within the bowl;

means for setting a reference plane within said conical part of said bowl and for configuring a helical volume beyond said reference plane so that said helical volume can be completely filled by wet solids during a centrifuging operation, wherein said helical volume is defined between said helical blade, said internal conical surface, and said conveyor hub; and, means for progressively reducing said helical volume between said reference plane and said solids discharge end by a progressive decrease of said acute angle as the diameter of the conical part of the bowl reduces towards said solids discharge end.

3. A decanting type centrifuge comprising:

a bowl journalled for rotation about a horizontal axis and having a cylindrical part with an internal cylindrical surface and a conical part with an internal conical surface, the bowl having a solids discharge end located at the smaller diameter end of the conical part and a liquid discharge end located at the end of the cylindrical part remote from said conical part, further, the bowl having a solids discharge outlet adjacent to the solids discharge end and a liquid discharge outlet adjacent to the liquid discharge end;

a scroll conveyor journalled for rotation within the bowl for separating a slurry, fed to the bowl, into its constituent solids and liquid, the scroll conveyor having a conveyor hub, mounted coaxially within said bowl, and a helical blade carried by said conveyor hub and having a front face which faces the solids discharge end;

the front face of the helical blade of the scroll conveyor, at least in the conical part of the bowl, making an acute angle with said internal conical surface;

means for rotating the bowl about said horizontal axis;

means for rotating the scroll conveyor at a differential speed within the bowl;

means for setting a reference plane within said conical part of said bowl and for configuring a helical volume beyond said reference plane so that said helical volume can be completely filled by wet solids during a centrifuging operation, wherein said helical volume is defined between said helical blade, said internal conical surface, and said conveyor hub;

means for progressively reducing said helical volume between said reference plane and said solids discharge end by a progressive reduction of the pitch of adjacent turns of said helical blade as the diameter of the conical part of the bowl reduces towards said solids discharge end.

4. A decanting type centrifuge comprising:

a bowl journalled for rotation about a horizontal axis and having a cylindrical part with an internal cylindrical surface and a conical part with an internal conical surface, the bowl having a solids discharge end located at the smaller diameter end of the conical part and a liquid discharge end located at the end of the cylindrical part remote from said conical part, further, the bowl having a solids discharge outlet adjacent to the solids discharge end and a liquid discharge outlet adjacent to the liquid discharge end;

a scroll conveyor journalled for rotation within the bowl for separating a slurry, fed to the bowl, into its constituent solids and liquid, the scroll conveyor having a conveyor hub, mounted coaxially within said bowl, and a helical blade carried by said conveyor hub and having a front face which faces the solids discharge end;

the front face of the helical blade of the scroll conveyor, at least in the conical part of the bowl, making an acute angle with said internal conical surface;

means for rotating the bowl about said horizontal axis;

means for rotating the scroll conveyor at a differential speed within the bowl;

means for setting a reference plane within said conical part of said bowl and for configuring a helical volume beyond said reference plane so that said helical volume can be completely filled by wet solids during a centrifuging operation, wherein said helical volume is defined between said helical blade, said internal conical surface, and said conveyor hub;

the conveyor hub having a cylindrical section remote from the solids discharge end, and a divergent section adjacent to the solids discharge end and within said conical part of the bowl, so as to progressively reduce said helical volume between said reference plane and said solids discharge end.

5. A decanting type centrifuge according to claim 4 wherein said divergent section of the conveyor hub contains perforations.

6. A decanting type centrifuge according to claim 5 wherein said helical blade includes helical support plates at a rear face thereof, at least from said reference plane to said solids discharge end, to further reduce the helical volume, and said perforations are located along a helix at the junction of the inclined flights and support plates.

7. A decanting type centrifuge according to claim 5 wherein said helical blade includes helical support plates at a rear face thereof, at least from said reference plane to said solids discharge end, to further reduce the helical volume, said perforations are located along a helix at the junction of the inclined flights and support plates.

8. A decanting type centrifuge comprising:

a bowl journalled for rotation about a horizontal axis and having a cylindrical part with an internal cylindrical surface and a conical part with an internal conical surface, the bowl having a solids discharge end located at the smaller diameter end of the conical part and a liquid discharge end located at the end of the cylindrical part remote from said conical part, further, the bowl having a solids discharge outlet adjacent to the solids discharge end and a liquid discharge outlet adjacent to the liquid discharge end;

a scroll conveyor journalled for rotation within the bowl for separating a slurry, fed to the bowl, into its constituent solids and liquid, the scroll conveyor having a conveyor hub, mounted coaxially within said bowl, and a helical blade carried by said conveyor hub and having a front face which faces the solids discharge end;

the front face of the helical blade of the scroll conveyor, at least in the conical part of the bowl, making an acute angle with said internal conical surface;

means for rotating the bowl about said horizontal axis;

means for rotating the scroll conveyor at a differential speed within the bowl;

means for setting a reference plane within said conical part of said bowl and for configuring a helical volume beyond said reference plane so that said helical volume can be completely filled by wet solids during a centrifuging operation, wherein said helical volume is defined between said helical blade, said internal conical surface, and said conveyor hub; and, the conveyor hub having a cylindrical hub section remote from the solids discharge end, and a convergent hub section adjacent to the solids discharge end and within said conical part of the bowl, said convergent hub section having an external convergent hub surface making a convergent hub angle with the horizontal axis, said convergent hub angle being smaller than a conical angle made by said internal conical surface with the horizontal axis, for progressively reducing said helical volume.

9. A decanting type centrifuge according to claim 8, wherein the convergent section of the conveyor hub contains perforations.

10. A decanting type centrifuge comprising:

a bowl journalled for rotation about a horizontal axis and having a cylindrical part with an internal cylindrical surface and a conical part with an internal conical surface, the bowl having a solids discharge end located at the smaller diameter end of the conical part and a liquid discharge end located at the end of the cylindrical part remote from said conical part, further, the bowl having a solids discharge outlet adjacent to the solids discharge end and a liquid discharge outlet adjacent to the liquid discharge end;

a scroll conveyor journalled for rotation within the bowl for separating a slurry, fed to the bowl, into its constituent solids and liquid, the scroll conveyor having a conveyor hub, mounted coaxially within said bowl, and a helical blade carried by said conveyor hub and having a front face which faces the solids discharge end;

the front face of the helical blade of the scroll conveyor, at least in the conical part of the bowl, making an acute angle with said internal conical surface;

means for rotating the bowl about said horizontal axis;

means for rotating the scroll conveyor at a differential speed within the bowl;

means for setting a reference plane within said conical part of said bowl and for configuring a helical volume beyond said reference plane so that said helical volume can be completely filled by wet solids during a centrifuging operation, wherein said helical volume is defined between said helical blade, said internal conical surface, and said conveyor hub;

and, means for progressively reducing said helical volume by a progressive decrease of said acute angle as the diameter of the conical part of the bowl reduces toward said solids discharge end, and a progressive reduction of the pitch of adjacent turns of said helical blade as a diameter of the conical part of the bowl reduces towards said solids discharge end.

11. A decanting type centrifuge comprising:

a bowl journalled for rotation about a horizontal axis and having a cylindrical part with an internal cylindrical surface and a conical part with an internal conical surface, the bowl having a solids discharge end located at the smaller diameter end of the conical part and a liquid discharge end located at the end of the cylindrical part remote from said conical part, further, the bowl having a solids discharge outlet adjacent to the solids discharge end and a liquid discharge outlet adjacent to the liquid discharge end;

a scroll conveyor journalled for rotation within the bowl for separating a slurry, fed to the bowl, into its constituent solids and liquid, the scroll conveyor having a conveyor hub, mounted coaxially within said bowl, and a helical blade carried by said conveyor hub and having a front face which faces the solids discharge end;

the front face of the helical blade of the scroll conveyor, at least in the conical part of the bowl, making an acute angle with said internal conical surface;

means for rotating the bowl about said horizontal axis;

means for rotating the scroll conveyor at a differential speed within the bowl;

means for setting a reference plane within said conical part of said bowl and for configuring a helical volume beyond said reference plane so that said helical volume can be completely filled by wet solids during a centrifuging operation, wherein said helical volume is defined between said helical blade, said internal conical surface, and said conveyor hub; and means for progressively reducing said helical volume, having a progressive decrease of said acute angle as the diameter of the conical part of the bowl reduces towards said solids discharge end, a progressive reduction of the pitch of adjacent turns of said helical blade as the diameter of the conical part of the bowl reduces towards said solids discharge end, and said conveyer hub having a cylindrical section remote from the solids discharge end and a divergent section adjacent to the solids discharge end and within said conical part of the bowl.

12. A decanting type centrifuge comprising:

a bowl journalled for rotation about a horizontal axis and having a cylindrical part with an internal cylindrical surface and a conical part with an internal conical surface, the bowl having a solids discharge end located at the smaller diameter end of the conical part and a liquid discharge end located at the end of the cylindrical part remote from said conical part, further, the bowl having a solids discharge outlet adjacent to the solids discharge end and a liquid discharge outlet adjacent to the liquid discharge end;

a scroll conveyor journalled for rotation within the bowl for separating a slurry, fed to the bowl, into its constituent solids and liquid, the scroll conveyor having a conveyor hub, mounted coaxially within said bowl, and a helical blade carried by said conveyor hub and having a front face which faces the solids discharge end;

the front face of the helical blade of the scroll conveyor, at least in the conical part of the bowl, making an acute angle with said internal conical surface;

means for rotating the bowl about said horizontal axis;

means for rotating the scroll conveyor at a differential speed within the bowl;

means for setting a reference plane within said conical part of said bowl and for configuring a helical volume beyond said reference plane so that said helical volume can be completely filled by wet solids during a centrifuging operation, wherein said helical volume is defined between said helical blade, said internal conical surface, and said conveyor hub; and means for progressively reducing said helical volume by a progressive decrease of said acute angle as the diameter of the conical part of the bowl reduces towards said solids discharge end, a progressive reduction of the pitch of adjacent turns of said helical blade as the diameter of the conical part of the bowl reduces towards said solids discharge end, and by the conveyor hub having a cylindrical hub section remote from said solids discharge end and a convergent section adjacent to the solids discharge end and within said conical part of the bowl, said convergent hub section having an external convergent hub surface making a convergent hub angle with the horizontal axis, said convergent hub angle being smaller that a conical angle made by said internal conical surface with the horizontal axis.

* * * * *

UNITED STATES PATENT AND TRADEMARK OFFICE

CERTIFICATE OF CORRECTION

PATENT NO. : 5,584,791

DATED : December 17, 1996

INVENTOR(S) : Grimwood et al.

It is certified that error appears in the above-identified patent and that said Letters Patent is hereby corrected as shown below:

In the title page, item [30] Foreign Application Priority Data, please delete " 9225067 " and insert -- 9225067.9 --.

Signed and Sealed this

Twenty-eighth Day of October, 1997

Bruce Lehman

*Attest:*

BRUCE LEHMAN

*Attesting Officer*

*Commissioner of Patents and Trademarks*